United States Patent [19]

Petersen

[11] Patent Number: 4,871,159

[45] Date of Patent: Oct. 3, 1989

[54] SHEET INSERTION APPARATUS

[75] Inventor: Godber Petersen, Augsburg, Fed. Rep. of Germany

[73] Assignee: Man Roland Druckmaschinen AG, Offenbach-am-Main, Fed. Rep. of Germany

[21] Appl. No.: 137,243

[22] Filed: Dec. 23, 1987

[30] Foreign Application Priority Data

Dec. 24, 1986 [DE] Fed. Rep. of Germany ..... 3644423

[51] Int. Cl.[4] ..... B65H 5/30

[52] U.S. Cl. ..... 270/55; 270/57; 271/204

[58] Field of Search ..... 270/55, 57, 58; 271/204, 206

[56] References Cited

U.S. PATENT DOCUMENTS

| | | | |
|---|---|---|---|
| 3,122,362 | 2/1964 | Vollrath | 270/57 |
| 4,046,367 | 9/1977 | Merker et al. | 270/55 |
| 4,408,755 | 10/1983 | Meier | 270/57 |
| 4,706,951 | 11/1987 | Leu | 270/55 |
| 4,743,005 | 5/1988 | Reist | 270/55 |

FOREIGN PATENT DOCUMENTS

| | | | |
|---|---|---|---|
| 278133 | 9/1914 | Fed. Rep. of Germany | 270/55 |
| 1949769 | 4/1970 | Fed. Rep. of Germany . | |
| 2706353 | 8/1977 | Fed. Rep. of Germany . | |
| 2631058 | 1/1978 | Fed. Rep. of Germany . | |
| 2182025 | 5/1987 | United Kingdom | 270/55 |

*Primary Examiner*—Robert E. Garrett
*Assistant Examiner*—Therese M. Newholm
*Attorney, Agent, or Firm*—Frishauf, Holtz, Goodman & Woodward

[57] ABSTRACT

To insert a plurality of insert sheets (2') simultaneously into multi-sheet products (2), for example folded inserts into already folded newspapers, a first carrier structure (3,3') retains the multi-sheet products in essentially open V-shaped position. A second carrier structure, located above the first carrier structure, retains the insert sheets. In accordance with the invention, for insertion, an auxiliary holder (19–26) grips insert sheets from the second carrier structure and, upon spreading apart of the first carrier structure, and downward movement of the auxiliary holder, transfers the inserts into the multi-sheet products. If the first carrier structure does not retain any multi-sheet products, the arrangement can also be used for transfer from one carrier structure to another and also to remove defective sheets from the second carrier structure by gripping them and depositing them on a defective-sheet transport belt (54).

11 Claims, 17 Drawing Sheets

SHEET INSERTION APPARATUS

Reference to related applications, assigned to the assignee of the present invention, the disclosure of which is hereby incorporated by reference:

U.S. Ser. No. 060,764, filed June 10, 1987, KOBLER et al., corresponding to German Pat. No. 36 21 834 of Sept. 17, 1987;

U.S. Ser. No. 056,857, filed May 29, 1987, KOBLER et al., corresponding to German Application No. P 36 21 822.7;

U.S. Ser. No. 056,787, filed May 29, 1987, PETERSEN, corresponding to German Application No. P 36 21 820.0.

U.S. Ser. No. 111,042, filed Oct. 20, 1987, SCHNEIDER, corresponding to German Application No. P 36 36 244;

U.S. Ser. No. 137,246, filed Dec. 23, 1987, PETERSEN, corresponding to German Application No. P 36 44 422.7 of Dec. 24, 1986.

German Pat. No. 26 31 58

German Pat. No. 19 49 769.

German Patent Disclosure Document No. DE-OS 27 06 353

U.S. Pat. No. 4,295,643

The present invention relates to an apparatus to insert a sheet or a plurality of sheets or folded sheets into connected sheet products, typically folded sheets which are folded to form a back or fold line, or sheets which are connected by staples at the back or the like, and which are transported in a transport apparatus in essentially V shape.

BACKGROUND

It has previously been proposed to construct an insertion machine in which a plurality of pockets are secured to an endless transport mechanism, so that they operate in an endless path. The multi-sheet product, typically a folded substrate which, at the fold line, then forms two sheets, can be inserted in the pocket and, after insertion of a single sheet or a folded insert, the now combined multi-sheet product with the insert can be supplied to a suitable output transport mechanism. The insertion machine is designed to insert, for example, an advertising insert into an already folded newspaper. The already folded newspaper is opened by means of a blade and is retained in open position during the insertion process.

The insertion machine of this structure operates serially, in that one folded product is opened, and insert placed therein, and then is ready to be delivered. The operating speed, thus, is limited and, if a plurality of such structures are to be built and arranged in parallel, for example to increase the output speed, the size of the apparatus becomes excessive.

U.S. Pat. No. 4,295,643 describes an arrangement in which folded products hang by a hanger bar engaged beneath their back, the folded products hanging open. Inserts can be introduced into these folded products which, however, are also introduced serially so that the placement of inserts, if parallel operation is desired, again results in a structure of substantial size.

THE INVENTION

It is an object to provide an apparatus into which sheet or connected sheet products can be combined with insert sheets or sheet products in minimum space, and permitting simultaneous insertion of a plurality of inserts into a plurality of folded products, without requiring change of the folded products from one structure to another.

Briefly, a first carrier structure retains a plurality of multi-sheet products in essentially V shape, open at the top. A second carrier structure, positioned at least approximately parallel to the first carrier structure, retains a plurality of insert sheets which are intended to be inserted in the multi-sheet V-shaped open products. In accordance with a feature of the invention, an auxiliary holder apparatus is provided, operatively associated with the second carrier structure and arranged for individually gripping the respective insert sheets. After the insert sheets have been gripped by the auxiliary holder, the second carrier structure is moved out of engagement with the insert sheets, to permit the insertion of the insert sheets into the multi-sheet products upon release of the grip on the insert sheets by the auxiliary holders.

The system of the present invention has the advantage that no additional structures are necessary to open or repeatedly open the multi-sheet products into which the insert is to be placed, and permits placing a plurality of inserts into a plurality of multi-sheet products, simultaneously. The system has the additional advantage that, upon selective control, some insert sheets which may be gripped and on which defects have been detected, need not be inserted into the folded products.

DRAWINGS

Figure 1:
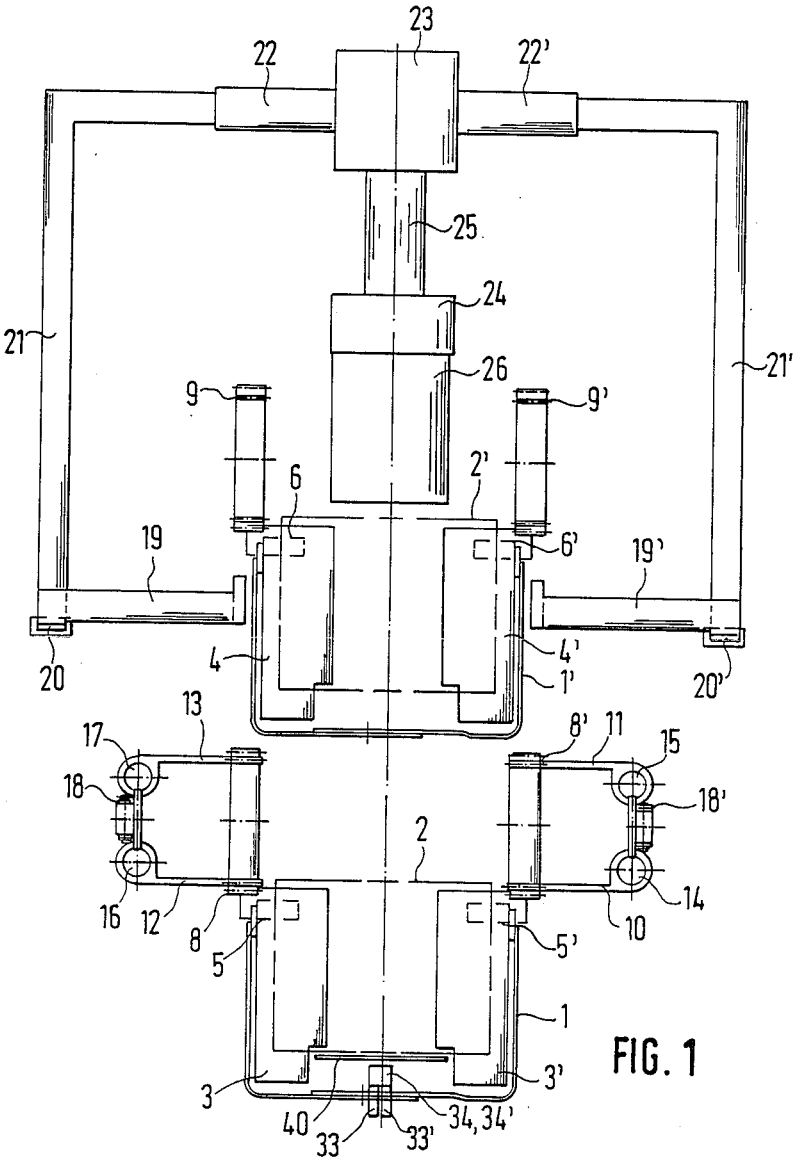
FIG. 1 is an upright end view of the structure of the present invention, in highly schematic form and omitting any elements not necessary for an understanding of the invention, and which are usually present in apparatus of this type, and which may be of any suitable and standard construction.
Figure 2:
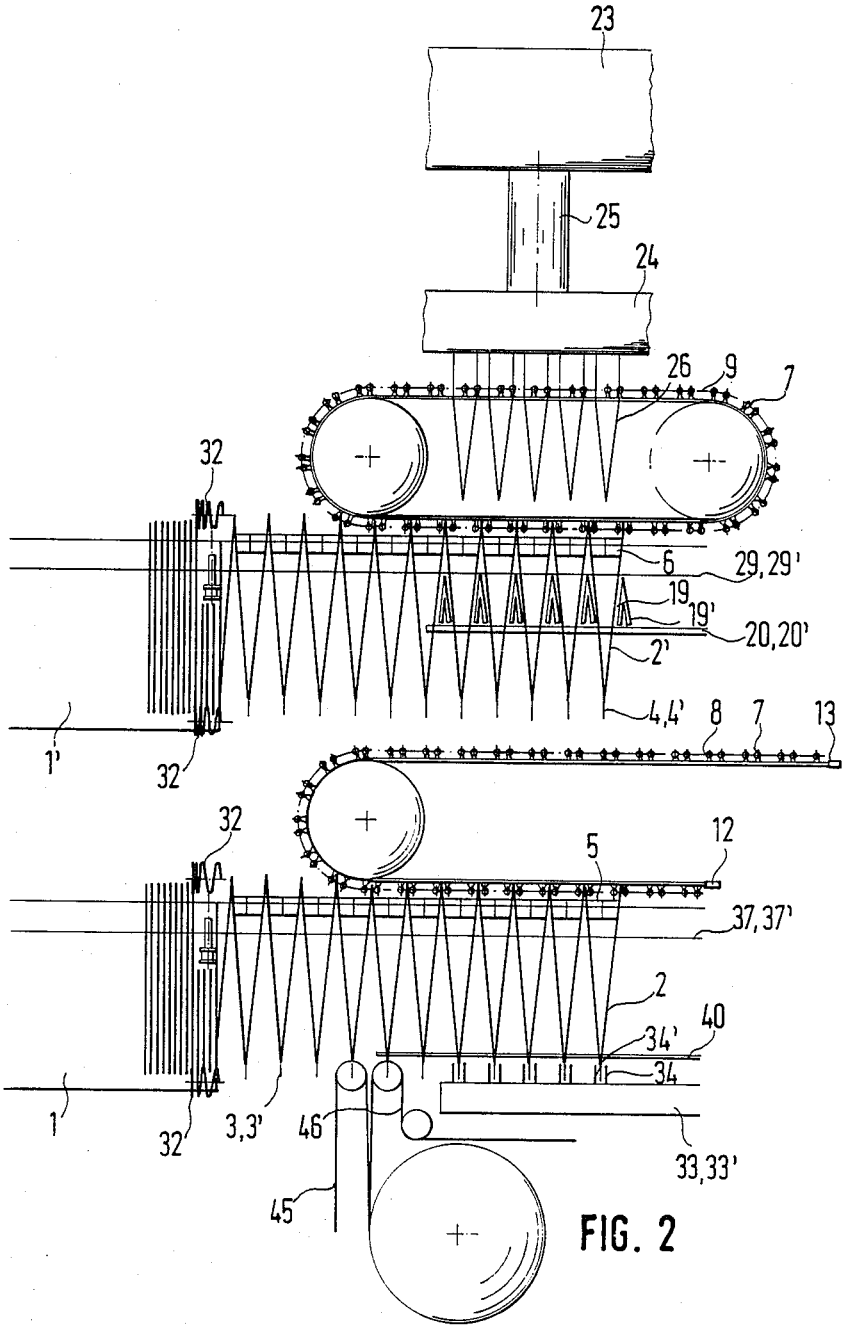
FIG. 2 is a side view of the apparatus of FIG. 1, and illustrates, again schematically and omitting features not necessary for an understanding of the invention, placement of inserts into folded products.
Figure 5:
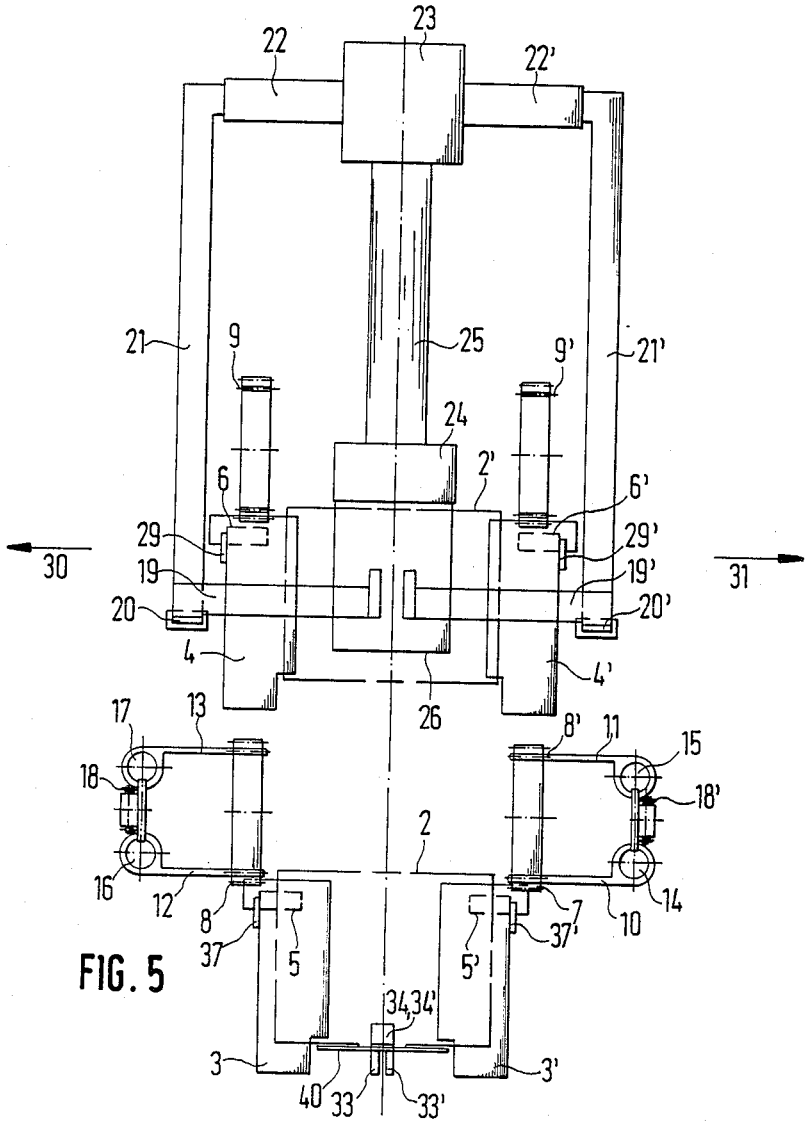
FIGS. 5 and 6 are views similar to FIGS. 1 and 2 and illustrating the insertion apparatus in a position in which the auxiliary holder has just gripped the inserts.
Figure 6:
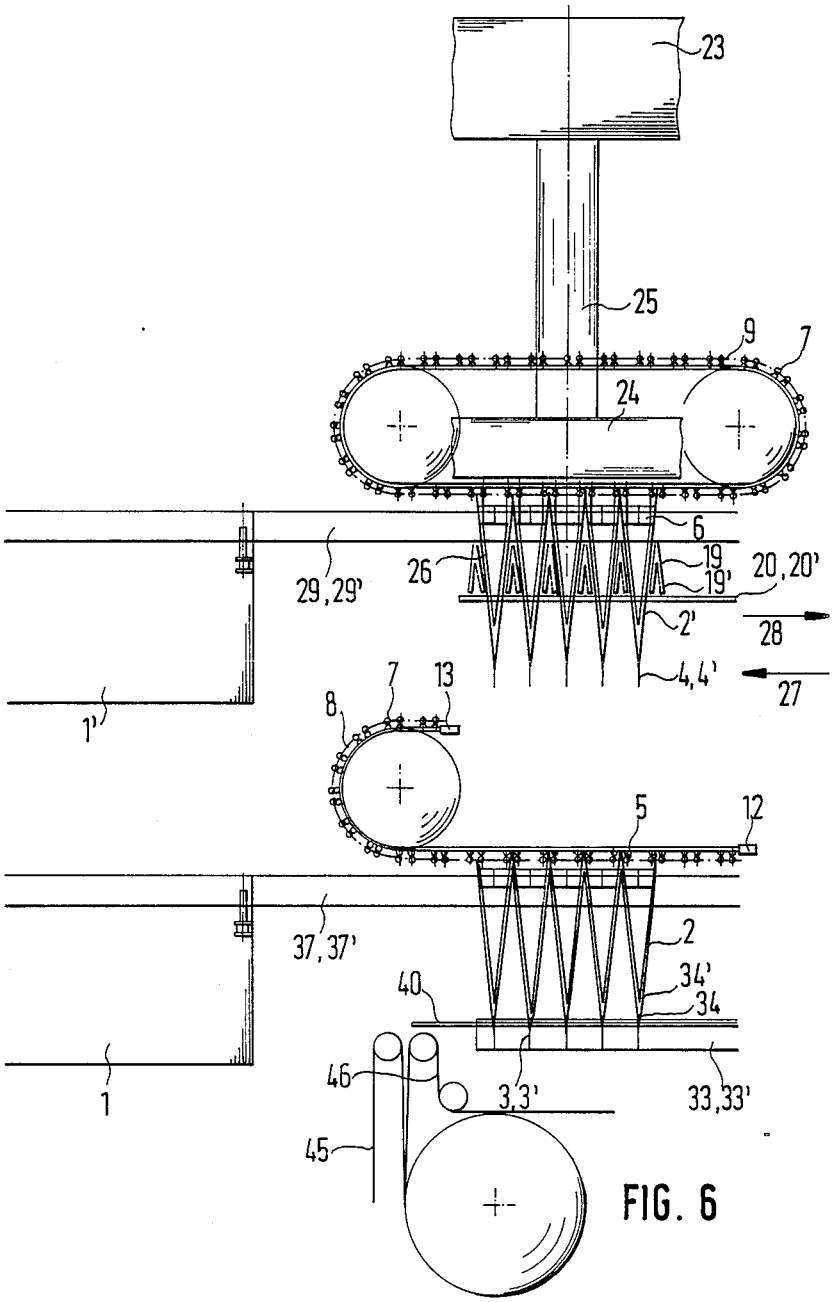
Figure 7:
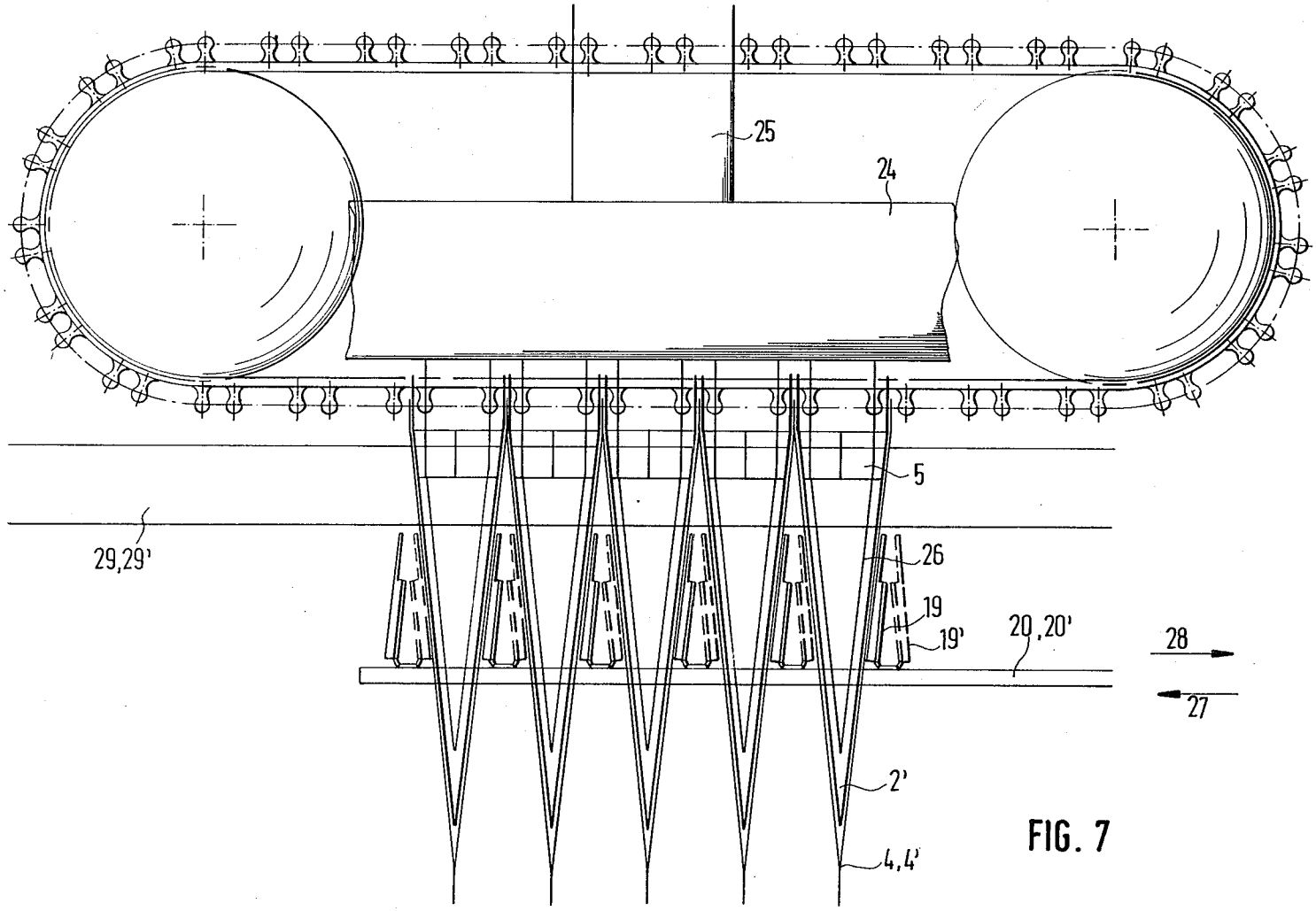
FIG. 7 is an enlarged fragmentary view of FIG. 6.
Figure 8:
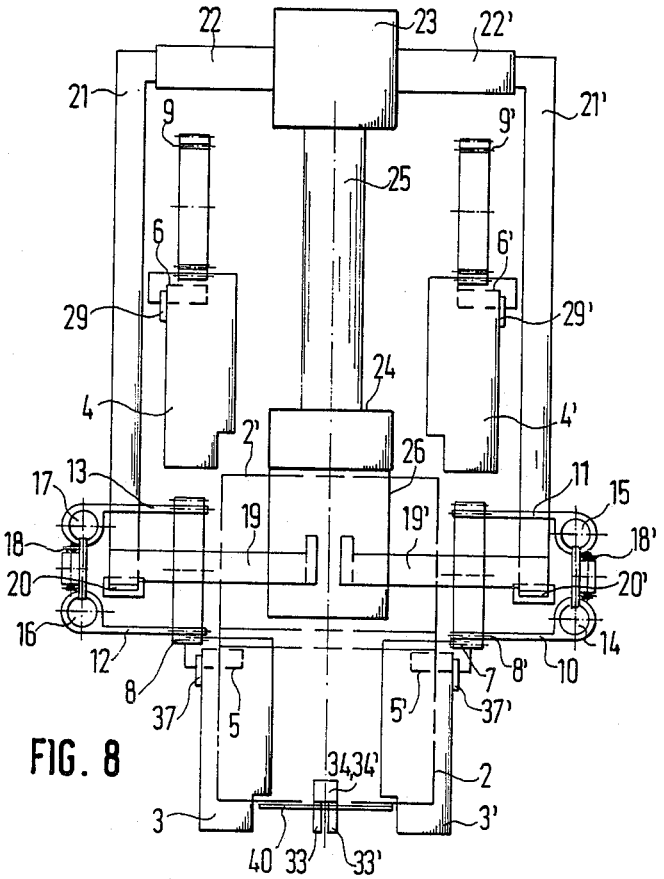
Figure 9:
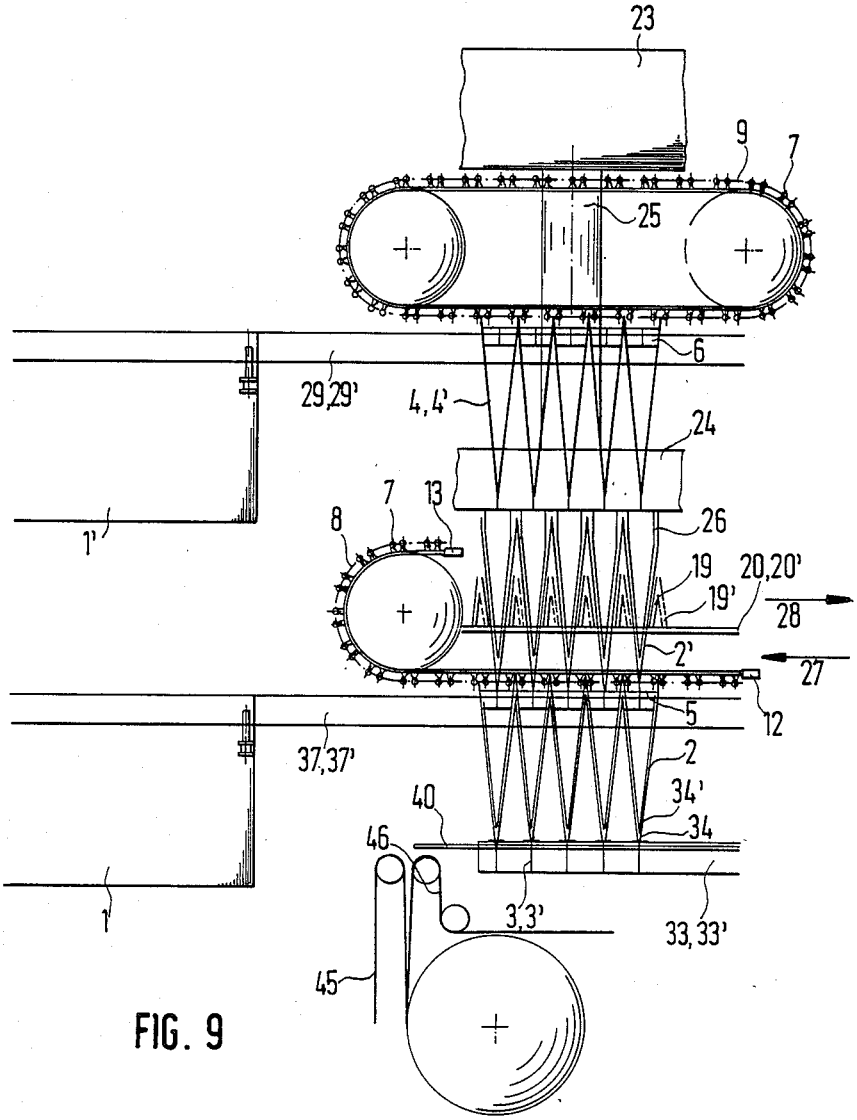
Figure 10:
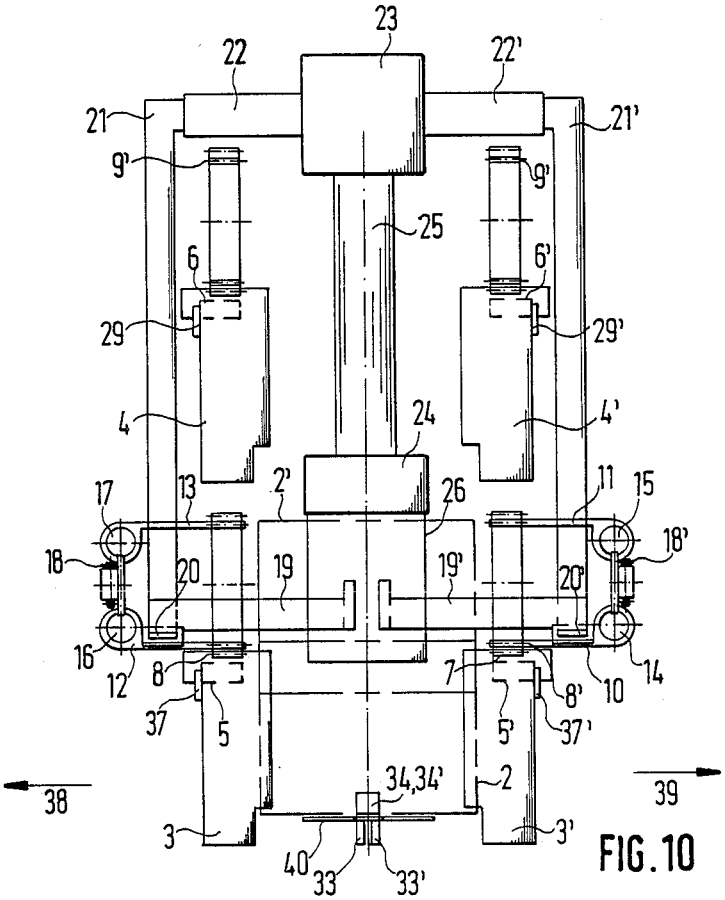
Figure 11:
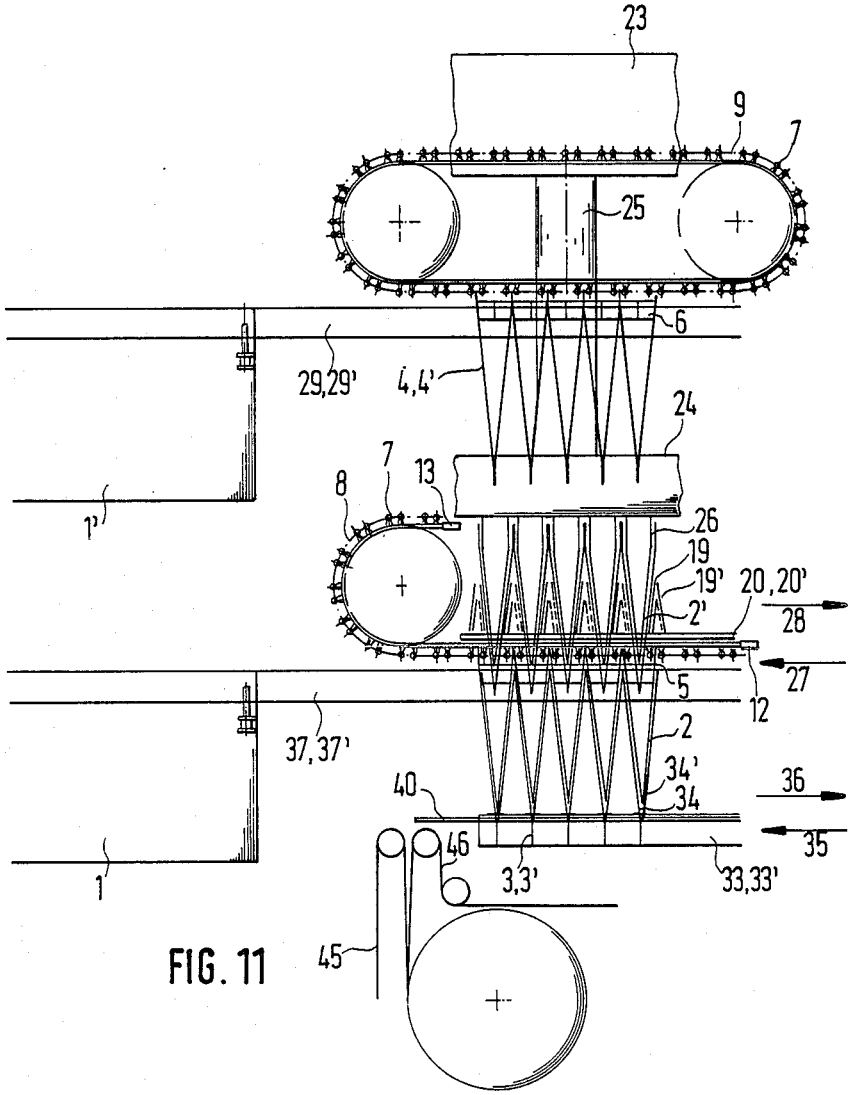
Figure 12:
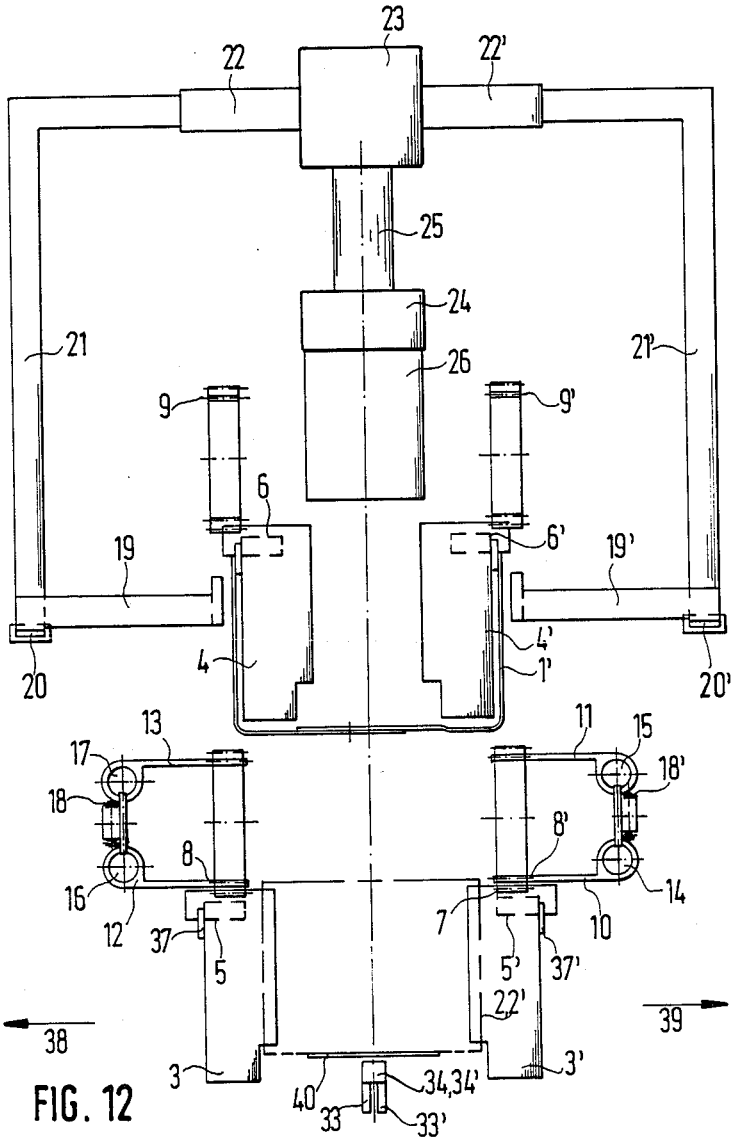
Figure 13:
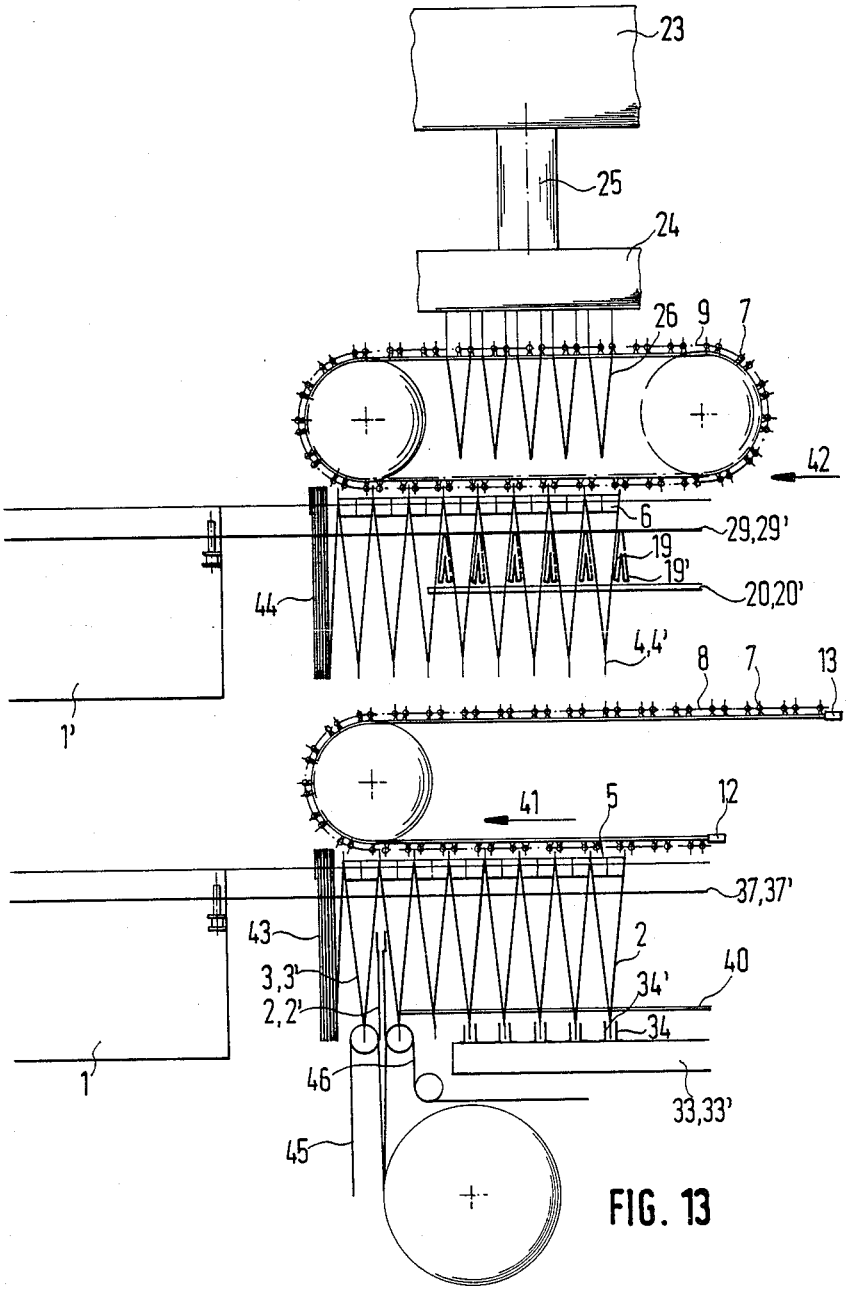
Figure 14:
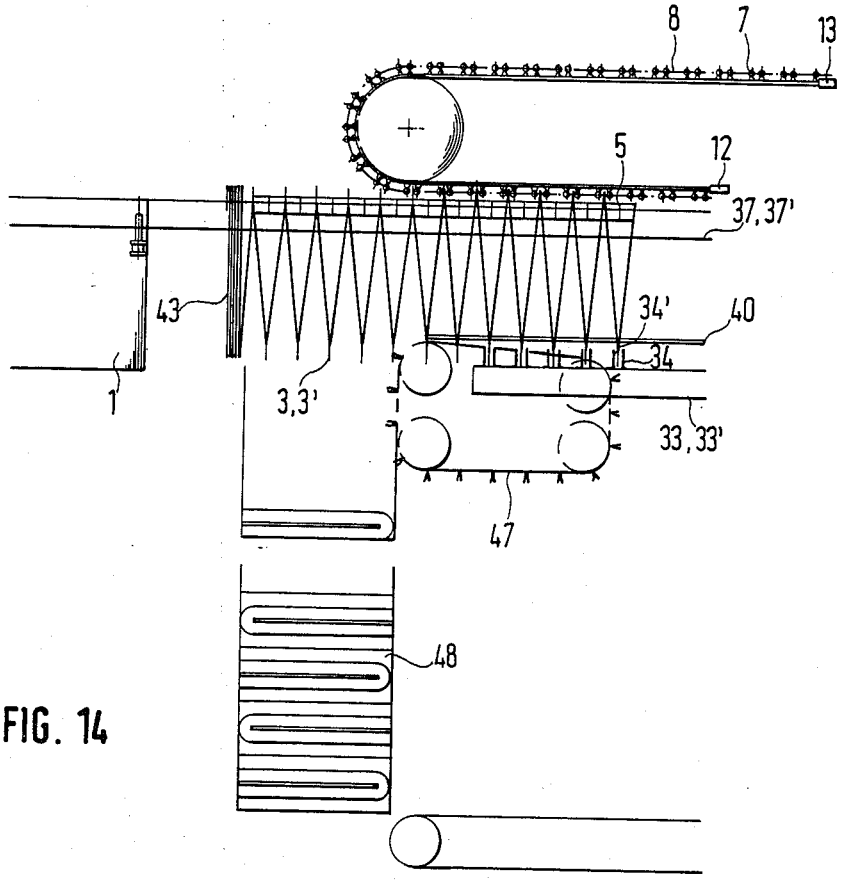
Figure 15:
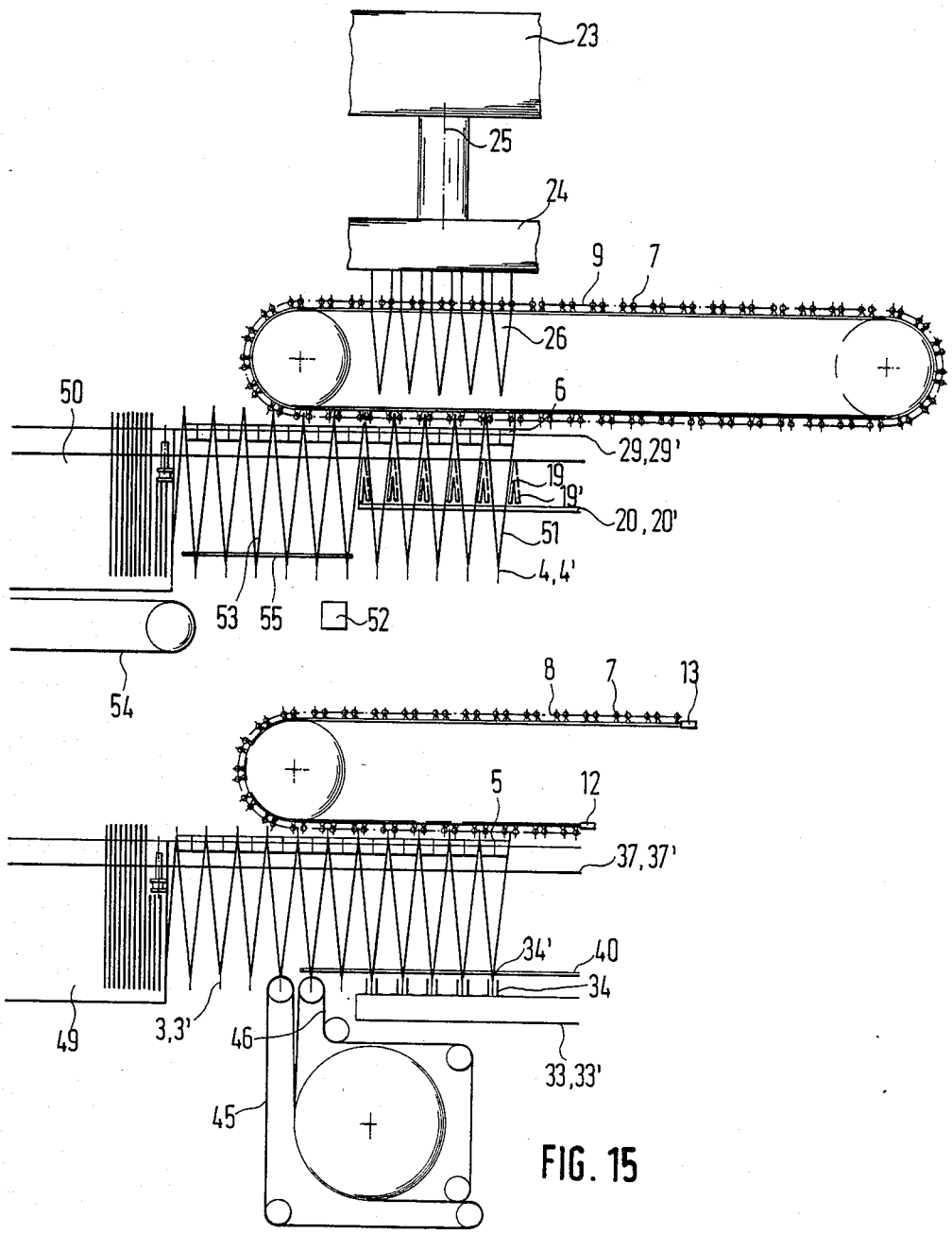
Figure 16:
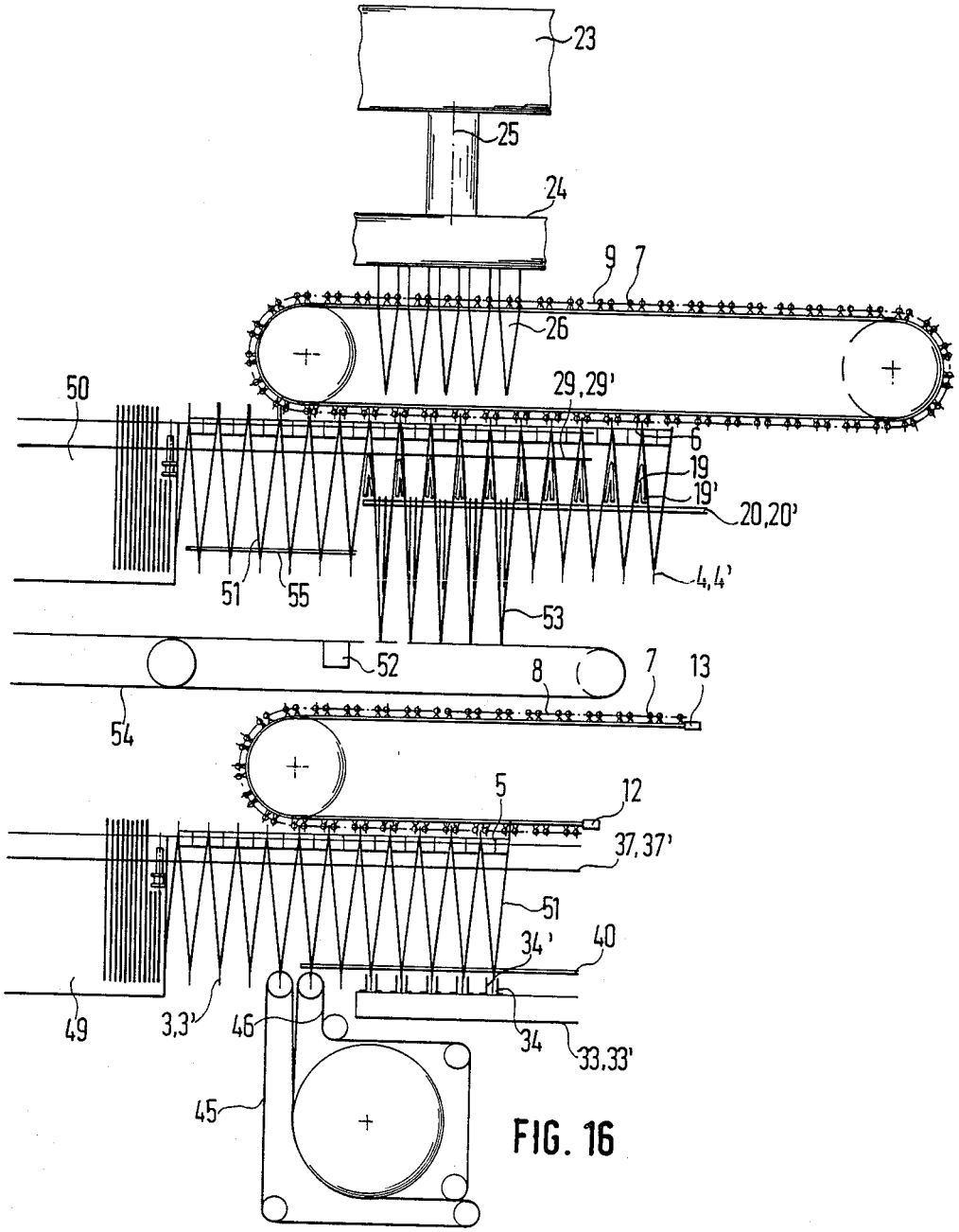
Figure 17:
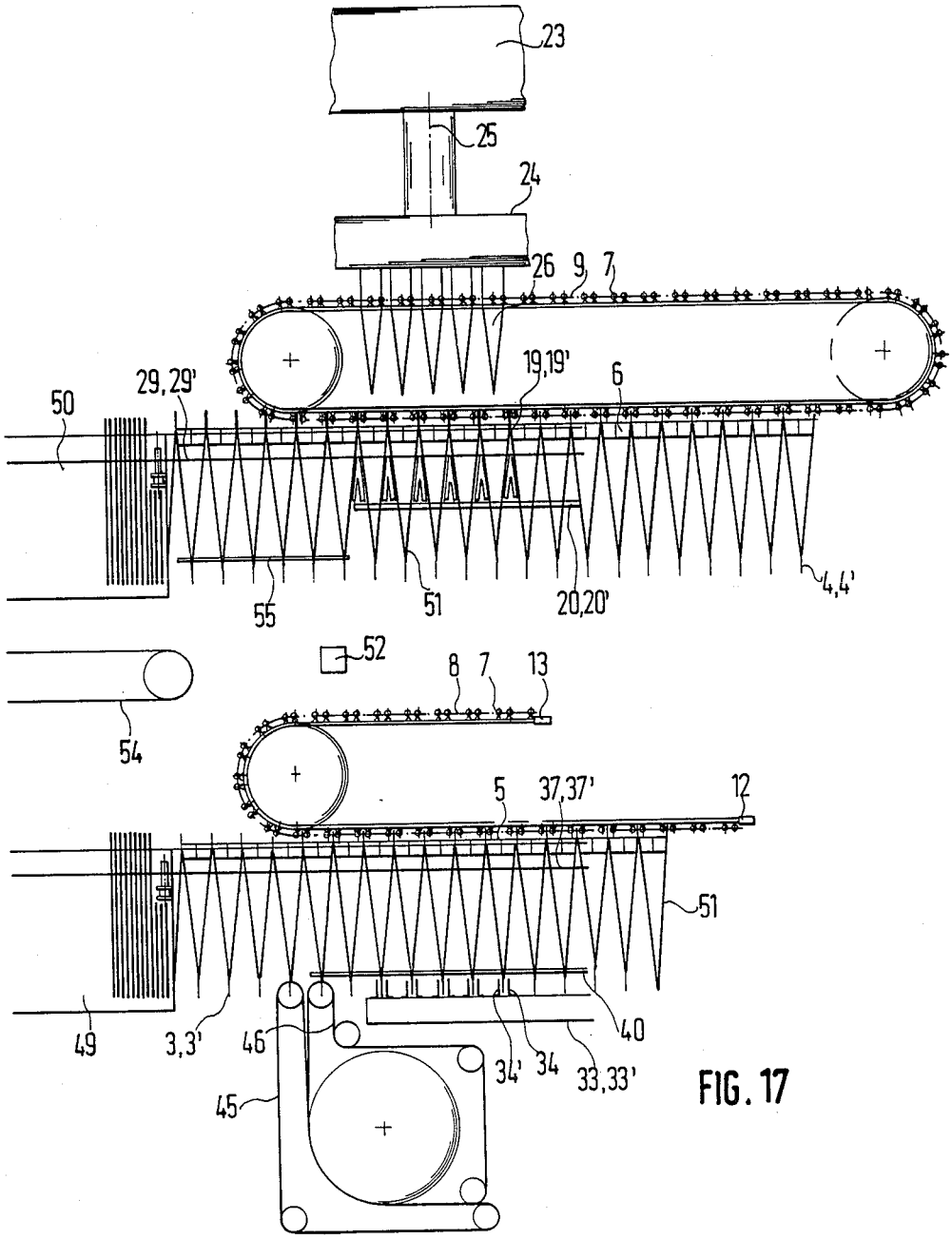

FIGS. 8 and 9 are views similar to FIGS. 1 and 2, and showing a position of the inserts subsequent to the illustration of FIGS. 5, 6 and 7, in which the inserts are already partly placed into the folded products;

FIGS. 10 and 11 are views similar to FIGS. 8 and 9, in which, however, the lower carrier structure has been expanded laterally;

FIG. 12 is a view similar to FIG. 10, however after the inserts have been introduced into the folded products and the auxiliary carrier structure has been raised;

FIGS. 13 and 14 are side views, similar to FIG. 2, and illustrating two embodiments of further transporting the folded products with inserts placed therein; and FIGS. 15, 16 and 17 are views similar to FIG. 2 and illustrating sequential steps if inserts which have been detected as being defective are to be prevented from being placed in the folded products.

DETAILED DESCRIPTION

Figure 3:
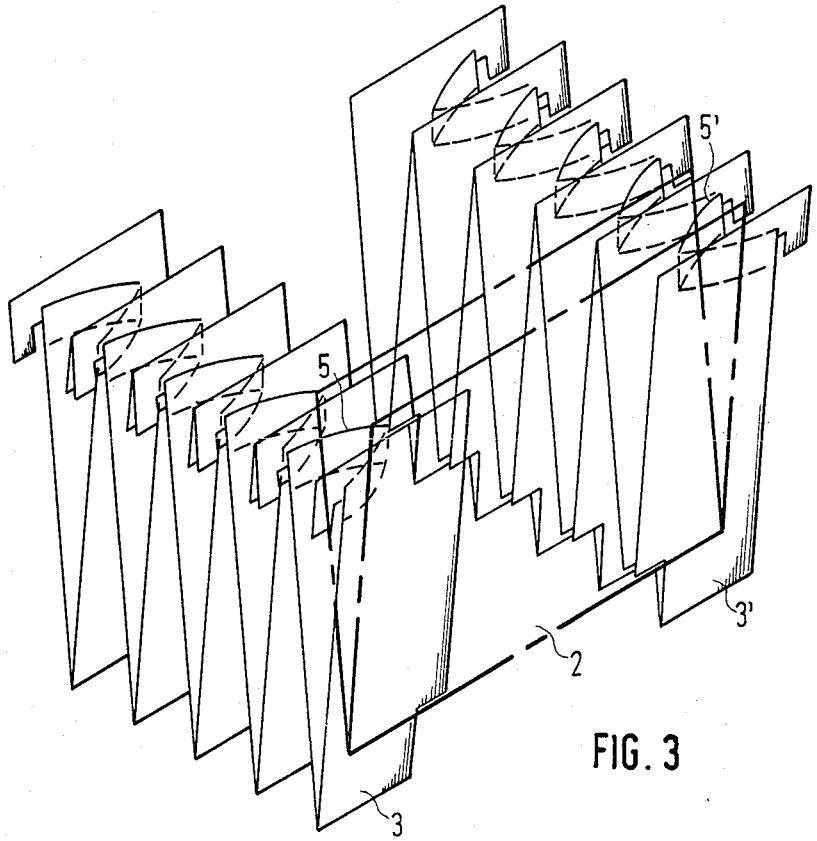
FIG. 3 is a perspective view of a carrier structure for the folded sheet products into which inserts are to be placed.

Referring first to FIGS. 1 and 2: Two storage magazines or holders 1, 1', preferably located one above the other, are used. The storage magazines can retain a plurality of carrier structures 3, 4. The carrier structures—see FIG. 3—include accordion-pleated elements which can be expanded, or pushed together, respectively. When pushed together, a substantial number of folded products can be stored in the carriers in minimum space. As best seen in FIG. 3, the carrier structures have two separate elements, one at the right side and shown at 3', and one at the left side shown at 3. The structures for the carriers 4 are identical and, therefore, have been given, similarly, reference numerals 4, 4'. The carrier structures, as best seen in FIG. 3, have extending V-shaped tongues 5, 5'.

The carrier structures 3, 3' and 4, 4' retain the products 2 in the lower carrier structure 3 and products 2' in the upper carrier structure 4, which products 2' are to be inserted into the folded products 2. Let it be assumed that the products 2 are sheet-like elements or substrates, so folded that two sheets, that is, a plurality of sheets, are connected by a back. Of course, and typically in the case of newspapers, many more than two such sheets may be interleaved already. Inserts 2' are to be placed into these multi-sheet products 2. For insertion and mixing of the products 2' with the multi-sheet products 2, it is necessary to move the multi-sheet products 2 from the storage set or cassette 1 and pull them apart. Likewise, the insert elements must be removed from the storage region or cassette 1' and also pulled apart. Upon expanding or pulling apart of the zig-zag carrier structures 3, 4, the multi-sheet products 2 as well as the inserts 2' are spread by the V-shaped tongues 5, 5' (FIG. 3) and, similarly, 6, 6', since the legs of the tongues 5, 5', 6, 6' spread apart as the carriers 3, 3', 4, 4' are spread. The tongue 5,6 are already present in the storage cassettes 1, 1' and between the individual sheets of the multi-sheet products 2 and, if the inserts likewise are multi-sheet products, between the inserts 2'. The carrier structures, and how they can be loaded, are described in the referenced applications and also in German Pat. No. P 36 21 834, to which U.S. application Ser. No. 060,764, filed June 10, 1987, KOBLER et al., corresponds.

Figure 4:
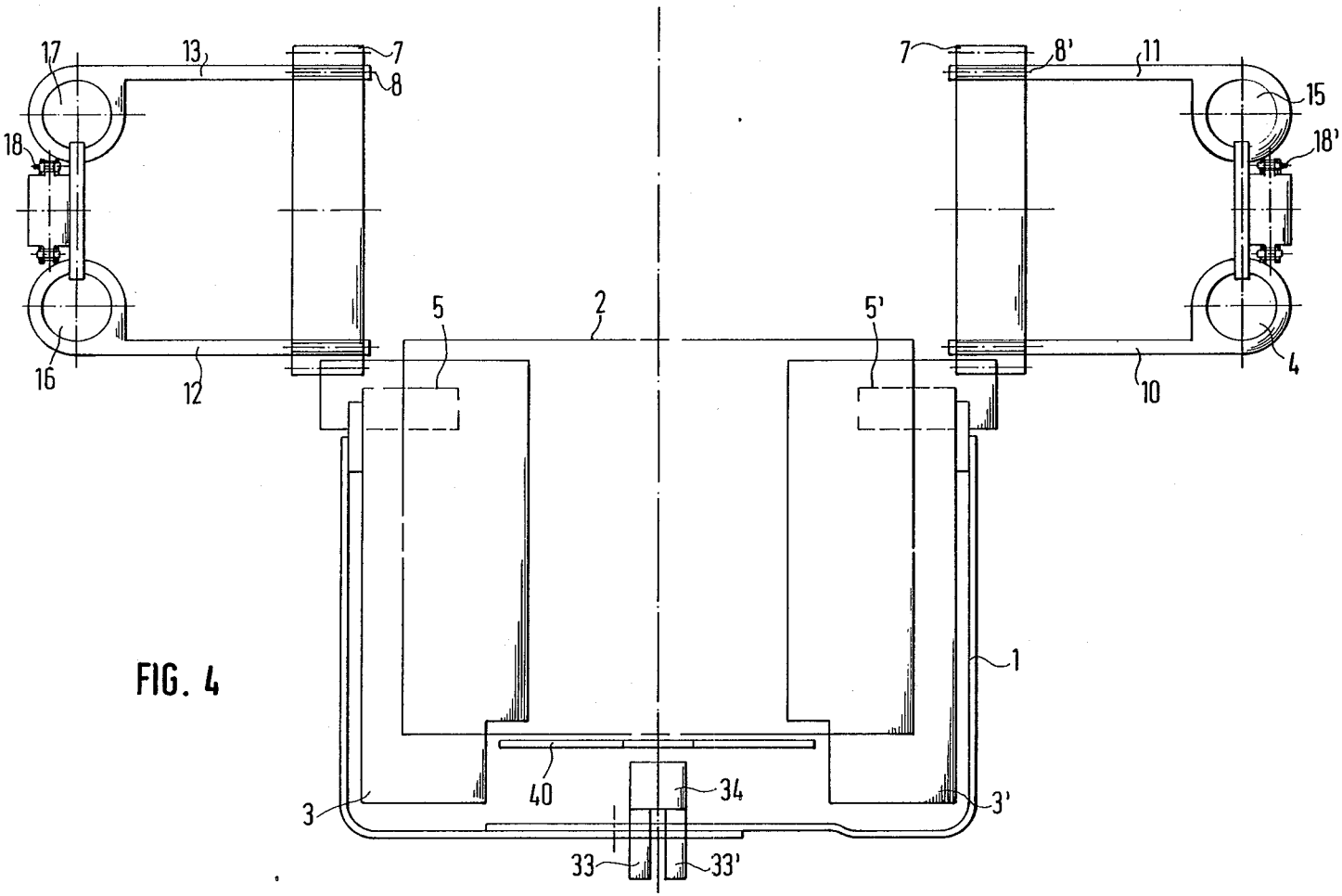
FIG. 4 is a fragmentary view of FIG. 1, to an enlarged scale.

FIG. 2 clearly shows how the respective carriers can be removed from the storage cassettes 1, 1'. Worms 32 engage the carriers at the region facing the insertion apparatus, and push the carriers towards the right (FIG. 2). The carriers are spread apart to be spaced by defined distances by drive chains 8, 8' for the lower carrier structures 3, 3', and 9, 9' for the upper carrier structures 4, 4'. After having pulled out a selected number of carrier structures 3, 4, which may be all or a portion of the carrier structures in the storage cassette 1, the respective carrier structures, with the folded products 2, 2' being open in V shape, are located above each other, and centrally aligned above each other. The drive chains 8, 8' and 9, 9' have cams 7 thereon in order to provide timed operation and precise alignment of the products above each other. The lower chains 8, 8' are endless chains which can move in either direction. The upper drive chains also are endless and form a closed loop. As seen in FIG. 4, the drive chains 8, 8' are driven by arms 10, 11, 12, 13, and running on longitudinal tracks 14, 15, 16, 17. The arms 10–13, in turn, are driven by chains 18, 18' which, in turn, are driven by a suitable drive source, not shown.

In accordance with a feature of the present invention, an auxiliary holder system 19–26 is used, which will now be described in detail. The auxiliary holder system includes holding arms 19 (FIGS. 1, 2, 7) and 19', which are secured to longitudinal guides 20, 20' and which can be introduced from the side—compare FIGS. 1 and 5—into the upper carrier structure 4, 4'. The longitudinal guides 20, 20' are secured to carrier arms 21, 21' (FIG. 1) which, in turn, can be shifted in longitudinal guides 22, 22'. The longitudinal guides 22, 22' are securely connected to a carrier 23 (FIGS. 1 and 2). FIG. 7 illustrates the holder elements 26 which, preferably, are generally triangular and which can be introduced between the carrier structures 4 at the open top side. The carrier structures 26 are located on a carrier element 24 (FIGS. 8, 9) which is connected with the carrier 23 over a shiftable longitudinal guide 25. The structures 26, thus, can be moved up and down. Thus, upon lowering the carrier structures 26, structures 26 can be introduced into the folded products 2' which, as noted, are V-shaped and open to the top. Before the structures 26 can be so introduced, however, the overall auxiliary holder system must also grip the products 2' within the carrier structures 4, 4'.

FIGS. 6 and 7 clearly show that a short movement of the longitudinal elements 20, 20', for example in the direction of the arrow 27 (FIG. 7), folded products 2' in the carrier structures 4, 4' will cause engagement of the arms 19, 19' with the folded products so that the folded products can be pressed against the structures 26 to be, or already inserted, therein. Thereafter, the rails 29, 29' together with the carrier structures 4, 4' thereon, move laterally in the direction of the arrow 30, 31, respectively (FIG. 5) so that the sheet elements 2, 2' are released from the carrier structures 4, 4' or, rather, the fingers 6, 6' therebetween. As best seen in FIGS. 8 and 9, the auxiliary holder arrangement, including the holder elements 19 and 26, and carrying the inserts 2', can be inserted in the multi-sheet products 2, by lowering the auxiliary holder apparatus 19–26 until the lower ends are positioned in the open multi-sheet products 2 just above the fingers 5, 5'. From the foregoing, and particularly FIGS. 6, 9 and 11, it is clear that, thereby, a plurality of inserts 2' can be gripped simultaneously and inserted simultaneously into products 2. Inserts 2' can be released simultaneously.

The next insertion step in shown in FIGS. 10 and 11. The rails 30 and 33 have grippers 34, 34' thereon and grip, from below, in counter-directed movement corresponding to the arrows 35, 36 (FIG. 11), the folded multi-sheet products 2. The carrier structures 3, 3', located on rails 37, 37' (FIGS. 10), are then moved laterally in the direction of the arrows 38, 39. The insert products 2' then are lowered to such an extent that the fingers 5, 5' of the carrier structures 3, 3' will be placed above the lower edge of the inserts 2', as seen in FIGS. 10 and 11.

If it is desired to store the multi-sheet products 2 after reception of the inserts 2', the rails 37, 37' are moved towards each other so that, together with the carrier structures 3, 3', they are returned into the previous position. In other words, they are moved counter the direction of the arrows 38, 39 to resume the position shown in FIGS. 5 and 8. The fingers 5, 5' now engage between the folded sheet insert products 2', held by the elements 26 and the arms 19, 19' of the insert mechanism. Upon retraction of the arms 19, 19' counter the previous direction of movement of arrows 30, 31, the insert products 2' can fall under gravity completely between the halves of the multi-sheet products 2, or, as an alternative, they can be positively moved by the carrier structures 26 until the bottom of the folded insert engages the fold line or bottom of the multi-sheet products 2. The element 26 can then be raised and the insertion cycle can be repeated with another group of cassettes or carrier structures.

After withdrawal of the element 26, the now joined multi-sheet products with the insert 2' can be stored, if desired, in the storage cassette 1 by reversing the direction of rotation of the drive chains 8, 8'. The above-described cycle is repeated until all the multi-sheet products in the storage cassette 1 have the inserts placed therein, for example until the multi-sheet products have the requisite number of sheets therein, for example by testing for a predetermined command or design thickness of the multi-sheet products.

Rails 37, 37' with the carrier structures 3, 3' will remain in the position shown in FIG. 12. After the structure 26 and the arms 19, 19' likewise have resumed the position shown in FIG. 12, the now completed multi-sheet products with the insert may also be removed. They are supported on a slide sheet 40 and, by suitable movement of the drive chains 8, 8', removed from the holders as shown, for example, in FIG. 13.

The carrier structures 3, 3' and 4, 4' form, upon movement of the drive chains 8, 8' and 9, 9', respectively, in the direction of the arrows 40, 42 (FIG. 13), a package which can be returned as empty package cassette in the storage systems 1, 1' merely upon spreading apart of the rails 29, 29' and 37, 37', respectively. The mixed or composite multi-sheet products 2 with the inserts 2' can then be removed by a belt transport system 45, 46, in accordance with well known transport technology for folded sheet products. The package of empty carrier structures is shown, schematically, at 43, 44, respectively.

Higher operating speed can be obtained by using a gripper chain 47—FIG. 14—which permits transfer of the sheets immediately to a cross-positioning storage stack 48 of well known construction, and standard in the paper and particularly folded paper, for example newspaper handling industry.

It may occur that some of the inserts are suspected of being defective. In order to test the printing on the inserts, and as shown, for example, in FIG. 15, the inserts as they are pulled out by the chains 9, 9' are placed not over a cassette or storage element 1 which has folded products therein but, rather, over a cassette 49 which holds only empty holders 3, 3'. The cassette which is suspected to contain defectively printed inserts, or other subject matter, is schematically shown at 50. As the cassette 50 is removed from the storage area and the respective carriers 9, 9' are spread apart—as described above—a sensor 52 of suitable and well known construction scans the respective inserts 51 therein.

Sensor 52 can also scan the inserts 51, for example, by scanning an optically legible code applied to improperly printed material which, for example, has previously been determined to be defective and supplied, for example, with a spot of contrasting color, sensed by the sensor 52. If the sensor 52 senses an insert 51 which is defective, drive of the chains 8, 8' and 9, 9' is disconnected and, as described above, the good or perfect inserts 51 are transferred into the empty carrier structures 3, 3'. Those carrier structures which, however, are sensed to be defective, are prevented from falling downwardly by a holder sheet 53, located in the path of the defective structures, at a position where the stopped drive chains 9, 9' hold back the defective insert 51. After insertion of the inserts 51 into the holders 3, 3', the drive chains 9, 9' can be moved again, whereas the chains 8, 8' coupled to the holders 3, 3' remain stationary. When the sensor 52 senses the end of a series, for example, of defective inserts 53, chain 9, 9' is stopped and a belt transport system 54 extended from the position shown in FIG. 15 to the position of FIG. 16 for removal of the defective inserts 53 upon lateral release of the rails 20, 20' to release the defective inserts 53. Thereafter, both chains 8, 8' are moved again, in synchronism, as seen in FIG. 17 and the then adjacent empty holders 3' of the lower cassette can be filled again with perfect inserts 51.

The holder structures 3, 3' and 4, 4' may retain printed products of different types or kinds which, by suitable characterization, for example by a characteristic colored ink spot, bar code, or the like, can be sensed, and the sensed information transferred to a central computer. Thus, specific different products can be supplied from one carrier structure to a selected other carrier structure. For example, it is possible to place inserts of different types, and located in different carriers 4, 4', to be inserted in one single main product 2, for example a daily newspaper. The carrier structures 3, 3', 4, 4' form pocket-like holders which can be supplied with different insert products, respectively, and the carrier structures themselves can, likewise, be coded so that their location in the cassette or position for insertion can be sensed and the sensed information transmitted to a central computer for transfer as inserts to a lower carrier structure, or for continued transport in the upper carrier structure or, for example, transport on an external transport belt system 54.

Various changes and modifications may be made within the scope of the inventive concept.

I claim:

1. Sheet insertion apparatus to place insert sheets (2') into a first carrier structure (3, 3'), particularly into folded sheet products (2) supported on the first carrier structure, wherein the first carrier structure (3, 3') is adapted to retain a plurality of folded sheets in essentially V-shaped open position, said carrier structure defining V-shaped open pocket-like elements;

a second carrier structure (4, 4') is provided, located at a predetermined position at least approximately parallel to said first carrier structure, and retaining a plurality of said insert sheets (2') for transfer of each of the respective insert sheets to said first carrier structure and into said open pocket-like elements, and comprising an auxiliary holder system (19–26) operatively associated with second carrier structure (4, 4'), including means for individually holding each of said plurality of insert sheets (2') and means for moving second carrier structure (44') away from said predetermined position after said individual holding means are holding said insert sheets to permit insertion of the insert sheets (2') into said first carrier structure (3, 3') upon release of the insert sheets (2') by said holder means.

2. The apparatus of claim 1, wherein each of said carrier structures comprise zig-zag or accordion-shape connected elements adapted to be collapsed against each other or drawn out or expanded to form said V-shaped open pocket-like elements;

rails (29, 29'; 37, 37') positioning said pocket-like elements and permitting, respectively, compression or expansion thereof; and drive means (8, 8'; 9, 9') engageable with said pocket-like elements and, respectively, moving said pocket-like elements longitudinally of said rails and maintaining said pocket-like elements in expanded V-shaped open position.

3. The apparatus of claim 1, wherein said auxiliary holder means (19–26) comprises holder arms (19, 19') engageable between said pocket-like elements of the second carrier structure and triangular elements (26) engageable from above into said pocket-like structure and adjacent an insert sheet (2'), said triangular elements (26) and said holder arms (19, 19') being relatively movable in a direction transverse to the major plane of said insert sheets for gripping said insert sheets therebetween.

4. The apparatus of claim 2, wherein said auxiliary holding means (19–26) comprises holder arms (19, 19') engageable between said pocket-like elements of the second carrier structure and triangular elements (26) engageable from above into said pocket-like structure and adjacent an insert sheet (2'), said triangular elements (26) and said holder arms (19, 19') being relatively movable in a direction transverse to the major plane of said insert sheets for gripping said insert sheets therebetween;

and wherein the rails (4, 4') of the second carrier structure are laterally movable, the auxiliary holder system being vertically movable for introducing said insert sheets into said first carrier structure (3, 3'), the first carrier structure, upon such introduction, being laterally movable to permit placement of said insert sheets (2') up to a folded edge thereof into said first carrier structure and into folded sheet products (2) retained therein under guidance of the auxiliary holder systems.

5. The apparatus of claim 4, wherein said first carrier structure retains folded sheet products (2) in at least some of said open pocket-like elements;

and, after insertion of the insert sheets (2') into the respective folded sheet products in the first carrier structure, the open pocket-like elements of the first carrier structure being movable towards each other;

and wherein said open pocket-like elements include V-shaped fingers (5, 5') engageable between insert sheets (2') introduced by said auxiliary holder system for retaining said insert sheets adjacent the folded sheet products retained in the first carrier structure.

6. The apparatus of claim 1, further including a first drive means (8, 8') engageable with said pocket-like elements of the first carrier structure;

and a second drive means, which second drive means is an endless drive means (9, 9') engageable with respective open pocket-like elements of the second carrier structure (4, 4').

7. The apparatus of claim 1, further including a guide element (40) located beneath the first carrier structure (3, 3') and positioned for engagement with a folded back of folded sheet products retained on said first carrier structure;

and removal transport means located beneath said first carrier structure and positioned for reception of folded sheet products upon passage of said folded sheet products over said guide element.

8. The apparatus of claim 1, further comprising sensing means (52) responsive to and sensing defective insert sheets (51) located in said second carrier structure (4, 4');

and a defect sheet transport means (54) positioned beneath said second carrier structure (4, 4') and above said first carrier structure (3, 3') for transfer of defective insert sheets to said defect sheet transport means upon release of said defective insert sheets from said auxiliary holding means.

9. The apparatus of claim 1, wherein said auxiliary holder system simultaneously holds a plurality of insert sheets (2') located in said second carrier structure (4, 4').

10. The apparatus of claim 9, wherein said auxiliary holder system simultaneously releases the insert sheets (2') for simultaneously transfer of said insert sheets to said first carrier structure (3, 3').

11. The apparatus of claim 2, wherein said auxiliary holder system simultaneously holds a plurality of insert sheets (2') located in said second carrier structure (4, 4') for simultaneous transfer of said insert sheets to said first carrier structure when said drive means has moved said pocket-like elements of the respective carrier structures longitudinally for maintenance of said pocket-like elements in expanded V-shaped open position.

* * * * *